US005988059A

United States Patent [19]

Hamu

[11] Patent Number: 5,988,059

[45] Date of Patent: Nov. 23, 1999

[54] SYSTEM FOR REGISTRATION OF WORK SUPPORT PALLETS WITH SCREEN FRAMES OF PRINTING MACHINES

[75] Inventor: Alan J. Hamu, Sunset Beach, Calif.

[73] Assignee: Olec Corporation, Irvine, Calif.

[21] Appl. No.: 09/174,684

[22] Filed: Oct. 19, 1998

[51] Int. Cl.[6] ..... B41F 15/18; B41F 15/36; B41F 15/26

[52] U.S. Cl. ..... 101/114; 101/126; 101/35; 101/41

[58] Field of Search ..... 101/114, 115, 101/41, 42, 126, 35

[56] References Cited

U.S. PATENT DOCUMENTS

| | | | |
|---|---|---|---|
| T918,002 | 1/1974 | Knoth | 101/41 |
| 4,054,091 | 10/1977 | Bradley | 101/129 |
| 4,907,506 | 3/1990 | Davis et al. | 101/115 |
| 4,911,070 | 3/1990 | Miske et al. | 101/126 |
| 5,014,614 | 5/1991 | Thieme | 101/128.1 |
| 5,226,362 | 7/1993 | Iaccino et al. . | |
| 5,315,929 | 5/1994 | Sundqvist | 101/127.1 |
| 5,806,422 | 9/1998 | Hamu . | |
| 5,845,569 | 12/1998 | Tkacz et al. | 101/115 |

*Primary Examiner*—Edgar Burr
*Assistant Examiner*—Daniel J. Colilla
*Attorney, Agent, or Firm*—Boniard I. Brown

[57] ABSTRACT

A system for registering a work support pallet on an arm of a printing machine with a screen frame of the machine has spaced-apart rods pivotally mounted on a pallet tool and on an arm of the machine for accurate shuttle movement of the pallet tool and a work support pallet thereon into proximity with the screen frame.

12 Claims, 2 Drawing Sheets

SYSTEM FOR REGISTRATION OF WORK SUPPORT PALLETS WITH SCREEN FRAMES OF PRINTING MACHINES

BACKGROUND AND SUMMARY OF THE INVENTION

The present invention is utilized with a carousel printing machine comprising a plurality of print stations with stationary screen frames spaced circumferentially about the machine, and arms with work support pallets thereon rotatable into positions under successive stationary screen frames for printing a plurality of registering images on a workpiece on each work support pallet. Such machines are shown and described in U.S. Pat. No. 5,226,362 to Iaccino, et al., and in U.S. Pat. No. 5,806,422 to Alan Hamu.

A work support pallet must register with respective screen frames at successive screen print stations. It has conventionally been required that work support pallets be removed and later re-mounted on machine arms in the process of alignment of work support pallets with screen frames. That is, a support pallet is removed, replaced with an alignment pallet or pallet tool, and then re-mounted and secured on the machine arm after registration with a screen frame. Time, labor, and expense are involved in such procedures.

The present invention provides the advantages of a pallet tool being pre-registered relative to a machine arm, and the pallet tool being essentially permanently on the arm, thereby simplifying or eliminating the necessity for alignment of work support pallets with machine arms and screen frames in successive operations. The removal of a support pallet from the arm and later re-assembly for registration are eliminated.

According to the invention, a pallet tool is supported relative to a machine arm by pairs of pivot arms pivotally mounted in spaced relation on the pallet tool and on the arm, thus to provide accurate movement of the pallet tool relative to the arm into proximity with a screen frame. The pallet tool is a relatively rigid structure to provide accuracy of its alignment relative to a machine arm and a work support pallet. With the work support pallet already accurately registered relative to the machine arm, independently of the pallet tool, the pallet tool is shuttled or swung into position in underlying relation with the work support pallet, the pallet tool maintaining alignment relative to the arm. Registration means, such as inter-engaging registration pins and openings are utilized to register the pallet tool with the screen frame.

DESCRIPTION OF THE PREFERRED EMBODIMENT

Figure 1:
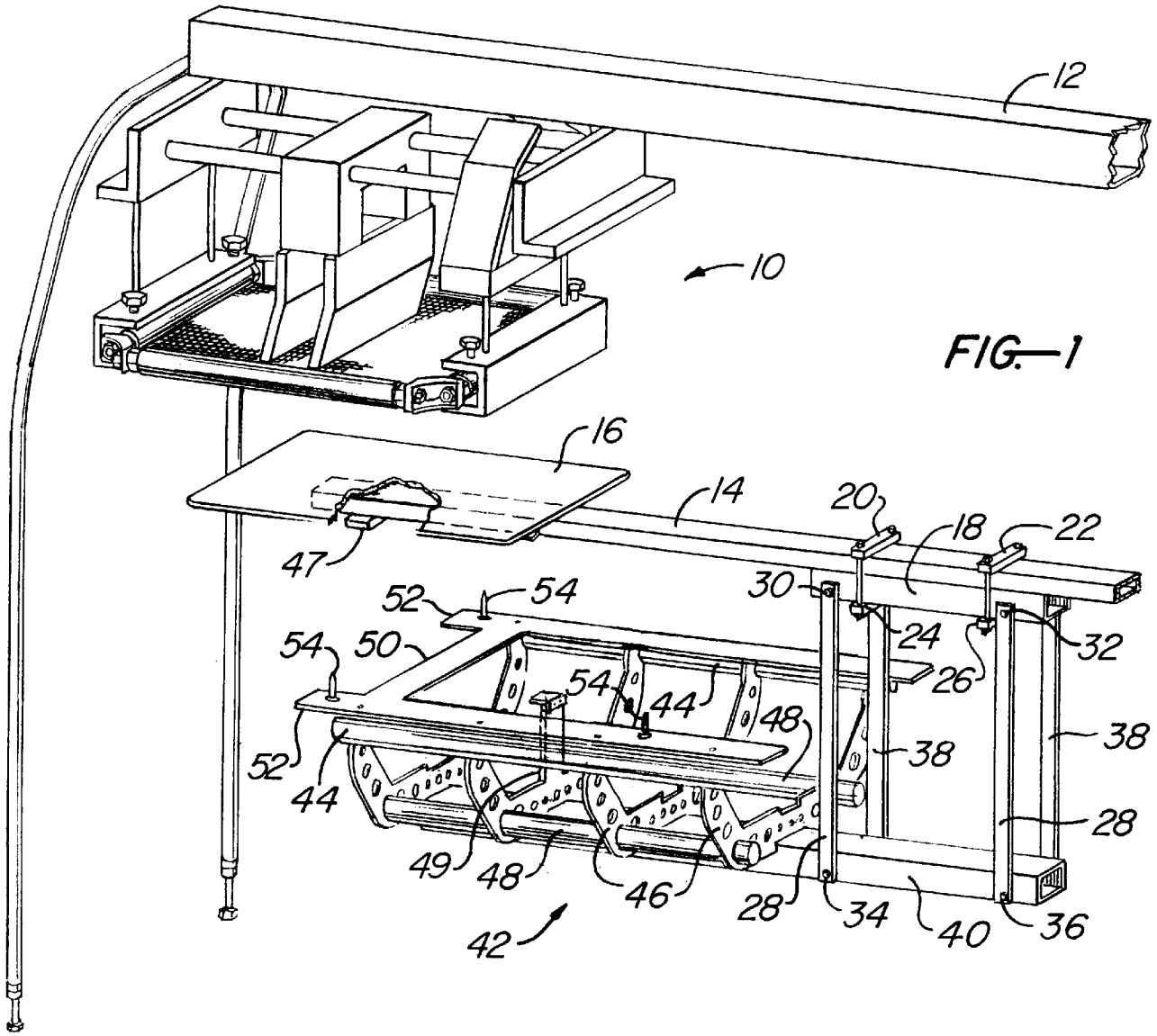
FIG. 1 is a perspective view of a registration apparatus according to the invention, including a pallet tool mounted relative to a machine arm by pairs of pivot arms pivotally mounted in spaced relation on the pallet tool and on the arm for accurate movement of the pallet tool relative to the arm.

Referring to the drawings, FIG. 1 shows a screen frame assembly 10 supported on a beam 12 which extends from a carousel printing machine (not shown). The screen frame is supported from the beam by conventional structure secured to the beam, as by welding, and the end of the beam is supported on a floor by vertically extending legs, upper portions of which are shown. An arm 14 extends from the carousel printing machine, and is one of a plurality of arms extending radially from a center of the machine.

A work support pallet 16 is secured rigidly to an outer portion of the arm in accurate alignment and registration with the arm. The securement may be by welding or fasteners (not shown). A pivot mount 18 is secured to the machine arm by a clamp arrangement comprising upper plates 20, 22 and lower plates 24, 26, secured in clamped relation with the arm and the pivot mount by threaded fasteners extending through openings in the plates on either side of the arm and secured by nuts, as shown.

A pallet tool 42 has a pair of upper longitudinal beams 44 extending through openings in a plurality of cross members 46. Lower longitudinal members 48 similarly extend through lower openings in the cross members. A lower pivot mount 40 is secured, as by welding, to lower portions of cross members 46. A plurality of openings in the cross members 46 reduce the weight of the pallet tool. A rigid box construction is thus provided. A relatively thin registration frame member 50 is secured, as by threaded fasteners or welding, atop upper longitudinal beams 44, and has extending portions 52, from which registration pins 54 extend upwardly.

A pair of pivot rods 28 are pivotally mounted 30, 32, 34, 36 (FIG. 1) in spaced-apart relation on one side of the arm 14. Spaced-apart pivot rods 38, 38 are similarly pivotally connected on the opposite side of the arm and to lower pivot mount 40.

Figures 2, 3:
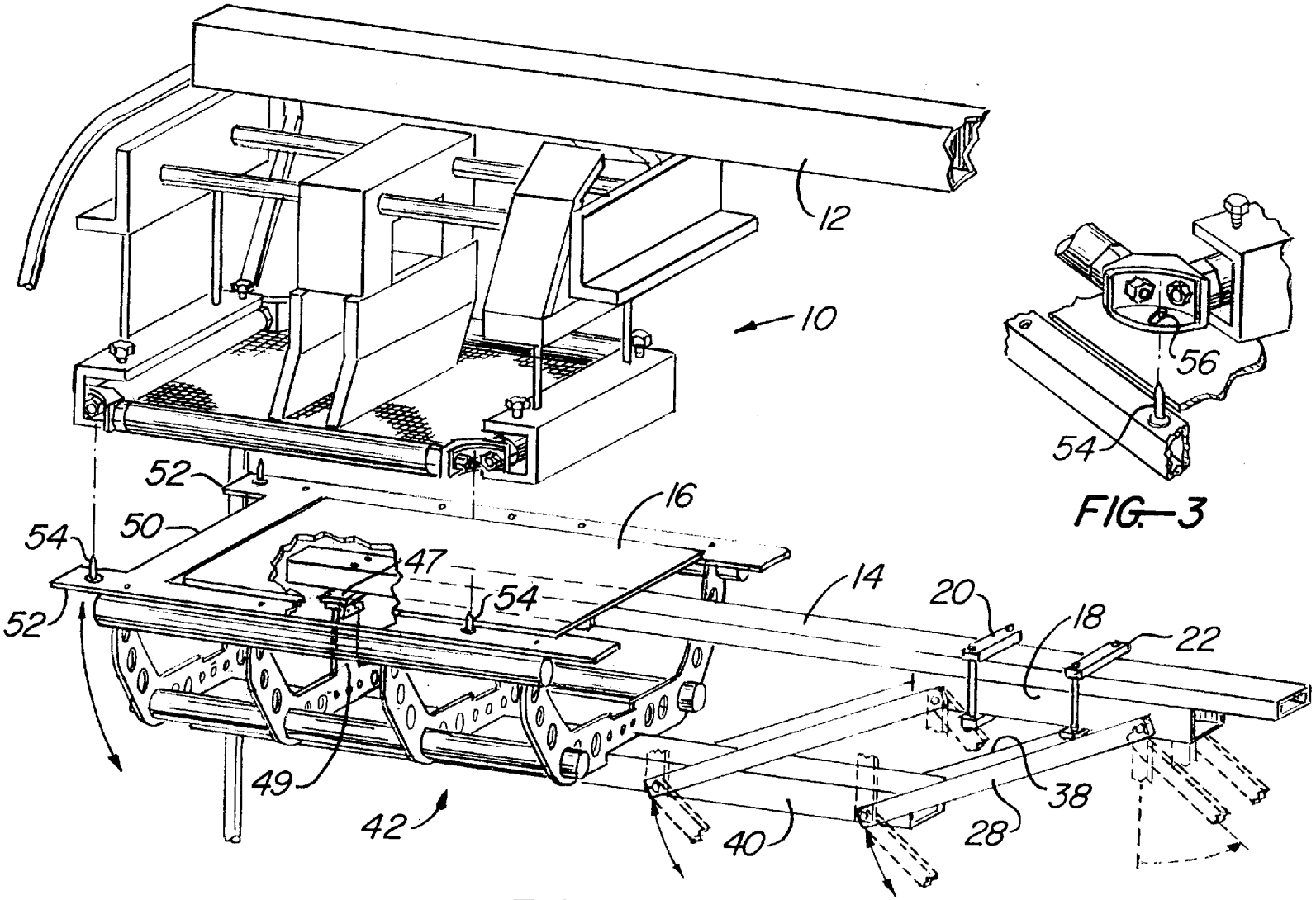
FIG. 2 is an enlarged perspective view showing the pallet tool of FIG. 1 underlying a silkscreen frame of a printing station.
FIG. 3 is a fragmentary perspective view showing a pin on a pallet tool in relation to an opening in the screen frame of FIG. 1.

A parallelogram bar arrangement provides accurate positioning and registration of the pallet tool relative to the machine arm, without reference to the work support pallet, in the swinging or shuttling of the pallet tool between its retracted position, shown in broken lines in FIG. 2, and its forward operative position under the screen frame, shown in FIG. 2, wherein the pallet tool is disposed under and in proximity to the screen frame.

In utilizing the pallet tool for the registering of a work support pallet with a screen frame, an operator grasps the pallet tool and swings or shuttles it from its retracted position, shown in broken lines in FIG. 2, or its suspended position of FIG. 1, and swings or shuttles it into the position shown in FIG. 2 wherein it places the work support pallet 16 thereon under the silkscreen frame 10. The work support pallet is then attached to the pallet tool by engagement of a magnet 47 secured, as by welding, on the lower side of the arm 14 with the end of an upwardly extending portion of member 49 which extends upwardly from a cross member 46 of the pallet tool, as shown. Other attachment means may be utilized between the arm and the pallet tool, such as a pin engaged in an opening, a latch arrangement or other appropriate devices.

The pallet tool may be essentially permanently attached to the machine arm, without necessity of detaching and later re-attaching the pallet tool for each operation, with resultant savings in labor, time and costs.

Registration of the work support pallet with the screen frame 10 is completed by inserting the preferably spring-loaded registration pins 54 on the pallet tool into registration openings 56 in the screen frame corner structures, as indicated in the partial view of FIG. 3.

After registration and printing on a workpiece on the work support pallet, the work support pallet is readily removable by swinging the pallet tool downwardly and outwardly.

The work support pallet is thus accurately registrable with each screen frame at successive stations of the printing machine. The procedure is repeated at each successive screen frame station. The screen frame is registered with the pallet tool so that the screen frames will all print in registration with each other on a workpiece, with successive images registering with each other.

Thus there has been shown and described a system for registration of work support pallets with screen frames of printing machines which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. Apparatus for registering a work support pallet on a printing machine arm with a screen frame, comprising:

a pallet tool, a first pair of pivot rods pivotally disposed in spaced relation on both the pallet tool and on said arm adapted to effect accurate movement of the pallet tool relative to said arm and into proximity with the work support pallet and the screen frame, and cooperating registration features on the pallet tool and on the screen frame for registration therebetween to secure the pallet tool in registration with the screen frame.

2. Apparatus according to claim 1, and further comprising:

a second pair of pivot rods pivotally mounted in spaced relation on a side of the arm opposite from the side on which said pair of pivot arms are disposed, and said first and second pairs of pivot rods cooperating for accurate shuttle movement of the pallet tool relative to the screen frame.

3. Apparatus according to claim 1, wherein the pallet tool comprises:

a plurality of upper and lower longitudinal beams, a plurality of cross members secured transversely on said longitudinal beams to provide a rigid box structure, and a registration member secured atop the upper ones of said upper longitudinal beams.

4. Apparatus according to claim 2, wherein the pallet tool comprises:

a plurality of upper and lower longitudinal beams, a plurality of cross members secured transversely on said longitudinal beams to provide a rigid box structure, and a registration member secured atop the upper ones of said upper longitudinal beams.

5. Apparatus according to claim 2, and further comprising:

a mounting member secured to the arm with said respective pairs of pivot rods mounted in spaced relation on respective sides of the mounting member.

6. Apparatus according to claim 1, wherein:

the pallet tool registration features comprise registration pins extending from at least two corners of the pallet tool, and the screen frame registration features comprise a corresponding number of registration openings at corners of the screen frame to receive said pins.

7. Apparatus according to claim 6, wherein the apparatus has three pallet tool registration pins and three corresponding screen frame openings.

8. Apparatus for registering work support pallets on extending arms of a carousel printing machine with successive screen frames of the machine for imprinting registering images on workpieces on the work support pallets, said apparatus comprising:

a work support pallet disposed on and aligned with an arm of the machine and adapted for registration with a screen frame of the printing machine, a pallet tool adapted to underlie the work support pallet, and at least one pair of pivot rods having lower portions pivotally mounted in spaced relation on the pallet tool and their opposite upper portions pivotally mounted in spaced relation relative to the arm, whereby the pallet tool is accurately swingable between a retracted position and a service position wherein the pallet tool is disposed beneath the screen frame for registration therewith of the work support pallet, and cooperating registration features on the pallet tool and on the screen frame for registering the work support pallet with the screen frame.

9. Apparatus according to claim 8, wherein the pallet tool is engaged with the work support pallet when the work support pallet is registered with the screen frame.

10. Apparatus according to claim 8, wherein the pallet tool comprises:

a plurality of upper and lower longitudinal beams, and a plurality of cross members secured transversely on said longitudinal beams to provide a rigid box structure.

11. Apparatus according to claim 8, and wherein:

said at least one pair of pivot rods comprises two pairs of pivot rods which are pivotally mounted in spaced relation on opposite sides of the arm and of the pallet tool, whereby parallelogram mechanisms are provided for accurate movement of the pallet tool relative to the arm and the work support pallet.

12. Apparatus according to claim 11, and further comprising:

a pivot mount secured to said arm on opposite sides of which said upper end portions of the respective parts of pivot rods are pivotally mounted in spaced relation and on opposite sides of the pivot mounting member, and a base mounting member on the pallet tool and adapted to pivotally mount lower end portions of the respective pairs of pivot rods in spaced relation and on opposite sides of the base mounting member.

* * * * *